US011168499B2

(12) United States Patent
Pavlow

(10) Patent No.: US 11,168,499 B2
(45) Date of Patent: Nov. 9, 2021

(54) DOOR STOPPER SYSTEMS, DEVICES, AND METHODS

(71) Applicant: Peter Pavlow, Caldwell, NJ (US)

(72) Inventor: Peter Pavlow, Caldwell, NJ (US)

( * ) Notice: Subject to any disclaimer, the term of this patent is extended or adjusted under 35 U.S.C. 154(b) by 334 days.

(21) Appl. No.: 16/253,943

(22) Filed: Jan. 22, 2019

(65) Prior Publication Data

US 2019/0226250 A1 Jul. 25, 2019

Related U.S. Application Data

(60) Provisional application No. 62/620,516, filed on Jan. 23, 2018.

(51) Int. Cl.
*E05C 17/54* (2006.01)
*E05C 17/00* (2006.01)

(52) U.S. Cl.
CPC ..... *E05C 17/54* (2013.01); *E05C 17/025* (2013.01); *E05Y 2900/132* (2013.01)

(58) Field of Classification Search
CPC ..... Y10T 292/11; Y10T 16/61; Y10T 292/34; Y10T 292/73; Y10T 70/7057; Y10T 16/54; Y10T 16/5401; Y10T 24/32; Y10T 292/444; Y10T 292/67; Y10T 292/68; E05C 17/56; E05C 19/16; E05C 17/54; E05C 17/025; E05C 17/46; E05C 19/182; Y10S 292/15; Y10S 292/17; Y10S 16/14; Y10S 52/04; Y10S 7/901; E05B 47/0038; E05B 47/004; E05B 17/2088; E05Y 2201/46; E05Y 2201/21; E05Y 2201/218; E05Y 2201/224; F16B 2001/0035
See application file for complete search history.

(56) References Cited

U.S. PATENT DOCUMENTS

| | | | | | |
|---|---|---|---|---|---|
| 3,244,443 | A * | 4/1966 | Rodgers | E05C 17/56 | 292/251.5 |
| 3,701,557 | A * | 10/1972 | Centofante | E05C 17/56 | 292/251.5 |
| 3,734,553 | A * | 5/1973 | Sugasawara | E05C 17/56 | 292/251.5 |
| 5,421,722 | A * | 6/1995 | Stemmann | A61C 8/0081 | 335/302 |
| 5,836,049 | A * | 11/1998 | Chiang | E05C 17/50 | 16/82 |
| 7,393,027 | B1 * | 7/2008 | Chen | E05C 17/56 | 16/82 |
| 2014/0084606 | A1 * | 3/2014 | Packer | E05C 17/54 | 292/343 |

(Continued)

FOREIGN PATENT DOCUMENTS

| | | | | |
|---|---|---|---|---|
| EP | 2154319 A2 * | 2/2010 | ..... | E05C 17/56 |
| GB | 2440541 A * | 2/2008 | ..... | E05C 17/54 |

*Primary Examiner* — Mark A Williams

(74) *Attorney, Agent, or Firm* — George Likourezos; Jason B. Scher; Carter, DeLuca & Farrell LLP

(57) ABSTRACT

A door stopper system includes a base, a plate, and a magnet. The base defines a bore and a first receiving recess. The first receiving recess is configured for wedged engagement with door structure to limit movement of a door of the door structure. The plate is configured to be fixed to the door. The magnet is mounted in the bore of the base. The magnet is configured to enable the base to be selectively secured to the plate.

19 Claims, 5 Drawing Sheets

(56) References Cited

U.S. PATENT DOCUMENTS

| | | | | |
|---|---|---|---|---|
| 2014/0183883 | A1* | 7/2014 | Millsap | E05C 17/54<br>292/288 |
| 2014/0225385 | A1* | 8/2014 | Millsap | E05C 17/025<br>292/288 |
| 2015/0040348 | A1* | 2/2015 | Header | E05C 17/46<br>16/82 |
| 2016/0145914 | A1* | 5/2016 | Fuentes | E05C 17/56<br>16/82 |
| 2016/0145925 | A1* | 5/2016 | Salice | A47B 88/463<br>312/334.44 |

* cited by examiner

DOOR STOPPER SYSTEMS, DEVICES, AND METHODS

CROSS REFERENCE TO RELATED APPLICATIONS

This application claims the benefit of U.S. Provisional Patent Application Ser. No. 62/620,516, filed Jan. 23, 2018, the entire contents of which are incorporated by reference herein.

TECHNICAL FIELD

The present disclosure relates to door stopper systems, and more particularly, to door stoppers for limiting movement of doors.

BACKGROUND

Door stoppers or doorstops are considered to be substantially bulky platforms designed to hold a door open or closed. Door stoppers are broadly used to prevent a door from swinging through when open. Common door stoppers are simple heavy solid objects, such as a rubber, placed in the path of the door. Some door stoppers are small and compact such as a small wedge of wood, rubber, plastic, cotton or another material. Manufactured wedges of these materials are commonly available. The wedge is usually kicked into position and the downward force of the door, now jammed upwards onto the doorstop, provides enough static friction to keep it motionless. These door stoppers can be easily disengaged and can become tripping hazards when not safely stored.

Efforts have been made to reduce unintended door stopper disengagement and tripping hazards. In general, such efforts include hook-and-eye hardware latches, spring stops, hinge pin stops and other various door stopping devices installed on the door, floor, and/or wall. However, these devices can require complicated installations and may cause permanent damage to the door, floor, and/or nearby wall.

SUMMARY

Accordingly, the present disclosure provides door stopper systems, devices, and methods for effectively limiting door movement and enabling easily accessible storage. For instance, the presently disclosed devices provide increased versatility in that they may be selectively stored on a door when not in use and/or selectively positioned under the door or between the door and doorframe to secure the door in an open position. The present disclosure provides door stopper systems and devices that are safely storable, easily accessible, and simply installed.

In accordance with one aspect of the present disclosure, a door stopper system includes a base, a plate, and a magnet. The base defines a portable body having a first receiving recess. The first receiving recess is configured for wedged engagement with door structure to limit movement of a door of the door structure. The plate is configured to be fixed to the door. The magnet is secured to the base and configured to enable the base to be selectively secured to the plate or to the door structure.

In embodiments, the base may define a cutout to facilitate gripping.

In some embodiments, the base may include a first wing that extends from a first side of the base to define the first receiving recess. The base may include a second wing that extends from a second side of the base to define a second receiving recess. The first and second receiving recesses may have different configurations.

In certain embodiments, the plate may include metallic material.

In embodiments, the door stopper system may further comprise a fastener that is configured to secure the plate to the door. The plate may define an aperture that is configured to receive the fastener.

According to another aspect of the present disclosure, a door stopper device is provided. The door stopper device includes a base and a magnet. The base defines a first receiving recess. The first receiving recess is configured for wedged engagement with door structure to limit movement of a door of the door structure. The magnet is secured to the base to enable the base to be selectively secured to a door or to the door structure.

In embodiments, the magnet may have a disk shape.

According to yet another aspect of the present disclosure, a door stopper device includes a base, a first wing, and a second wing. The base has a first side and a second side. The first wing extends from the first side of the base to define a first receiving recess. The second wing extends from the second side of the base to define a second receiving recess. The first and second receiving recesses are configured to engage door structure to limit movement of a door of the door structure.

In some embodiments, the first receiving recess may have a first depth and the second receiving recess may have a second depth different from the first depth.

In certain embodiments, the first wing and the second wing have different widths and different lengths.

In embodiments, the base may include a gripping surface configured to frictionally engage a floor to prevent movement of the door.

In some embodiments, the base may include a mounting face that defines a bore configured to receive a magnet therein.

Advantageously, the presently disclosed door stopping device can securely maintain a door open at a selected angle, for instance, a 90 degree angle. The presently disclosed door stopping devices are suitable for engagement with a variety of doors, door hinges, doorframes, and/or doorjambs to selectively limit movement thereof.

Other aspects, features, and advantages will be apparent from the description, the drawings, and the claims that follow.

BRIEF DESCRIPTION OF THE DRAWINGS

The accompanying drawings, which are incorporated in and constitute a part of this specification, illustrate embodiments of the presently disclosed door stopper systems and devices and, together with a general description of the disclosure given above, and the detailed description of the embodiment(s) given below, serve to explain the principles of the disclosure.

DETAILED DESCRIPTION

Figure 1:
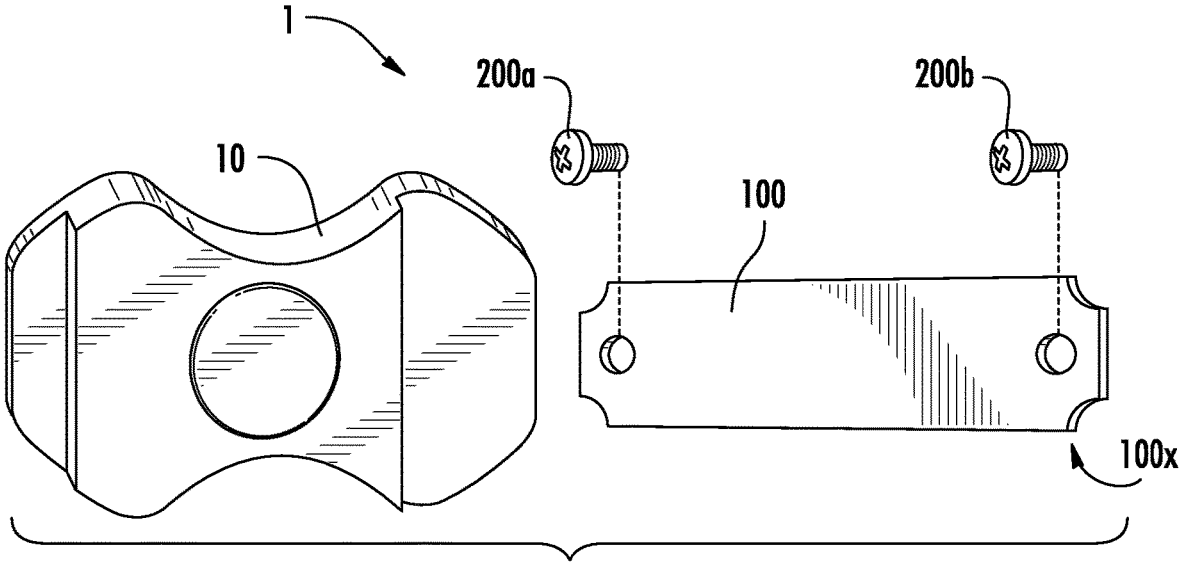
FIG. 1 is a perspective view of a door stopper system in accordance with the present disclosure.
Figure 2:
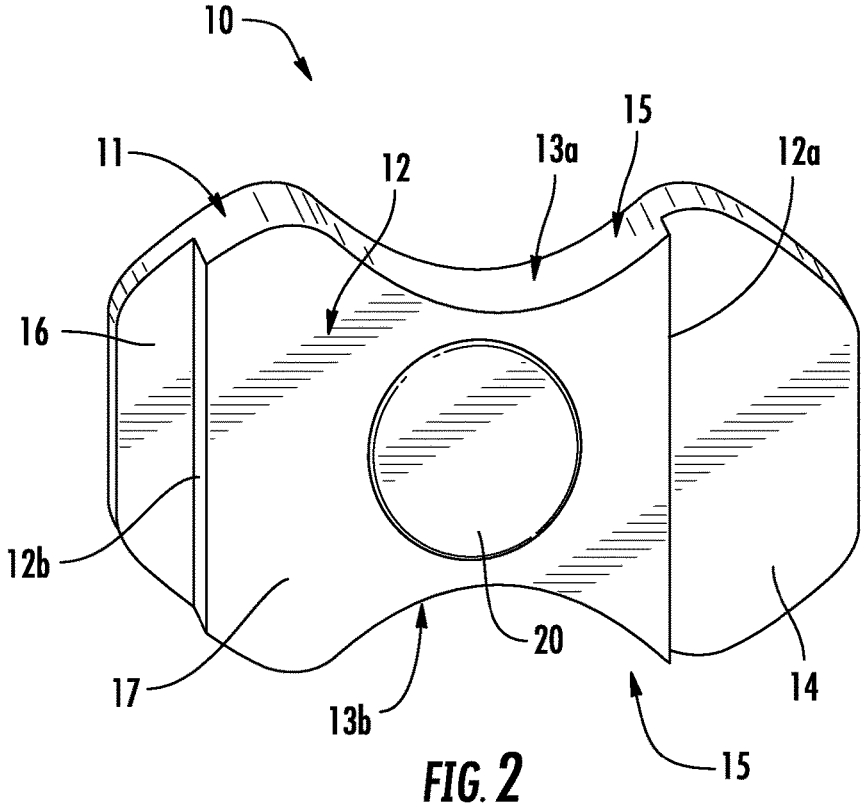
FIG. 2 is a perspective view of a door stopper device of the door stopper system of FIG. 1.

Embodiments of the presently disclosed door stopper systems and devices are described in detail with reference to the drawings, in which like reference numerals and letters designate identical or corresponding elements in each of the several views. Further, terms used herein such as "upper," "lower," "side" and similar directional terms are used simply for convenience of description and are not intended to limit the disclosure.

In the following description, well-known functions or constructions are not described in detail to avoid obscuring the present disclosure in unnecessary detail.

Figure 4A:
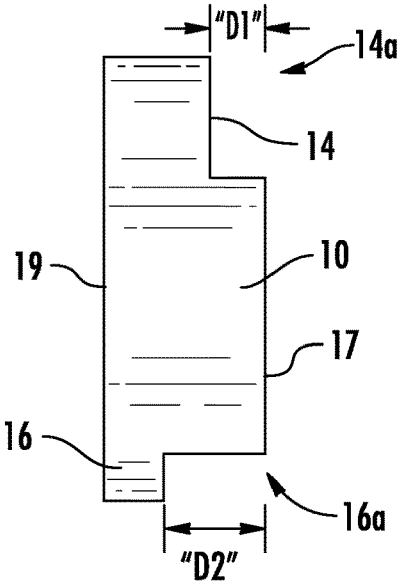
FIG. 4A is a side view of the door stopper device of FIG. 2.
Figure 4B:
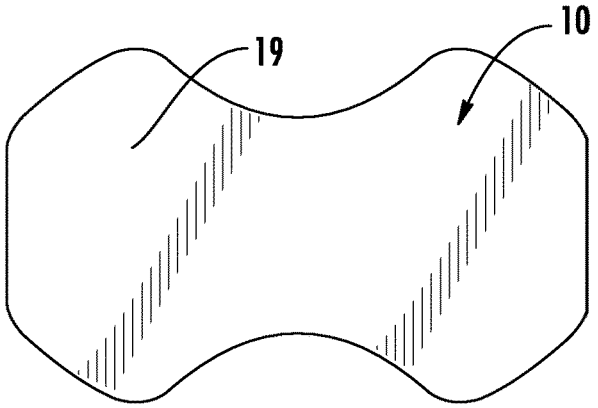
FIG. 4B is a back view of the door stopper device of FIG. 2.
Figure 5:
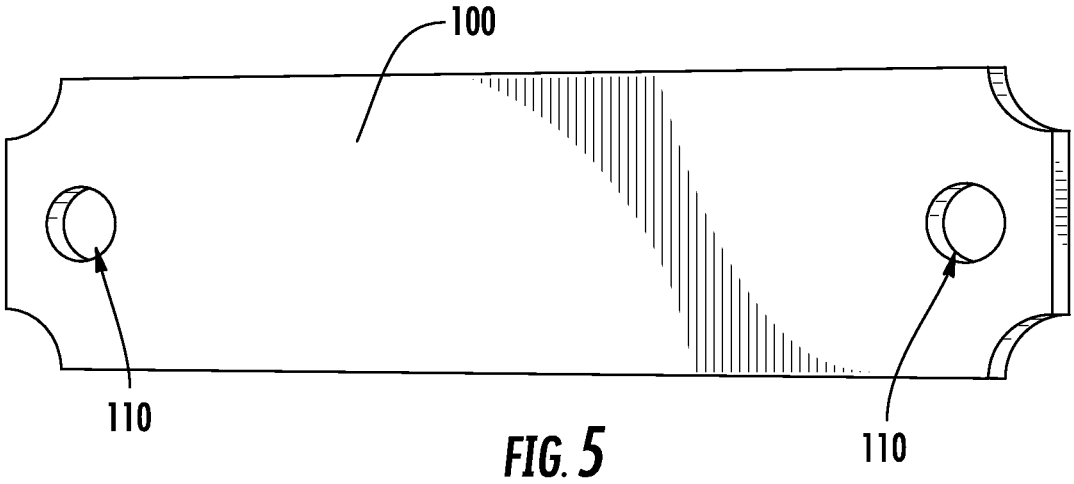
FIG. 5 is a perspective view of a plate of the door stopper system of FIG. 1.

Referring now to FIGS. 1-9, a door stopper system is generally referred to as 1. The door stopper system 1 includes a door stopper device 10 and a plate assembly 100*x*. The plate assembly 100*x* includes a plate 100 and fasteners 200*a*, 200*b* that secure plate 100 to a door "D" (see FIG. 7), wall, cabinet, or other surface, etc. As seen in FIG. 5, plate 100 defines apertures 110 that are configured to receive fasteners 200*a*, 200*b* to enable fasteners 200*a*, 200*b* to secure plate 100 to the door "D." The door "D" can have any suitable structure such as an edge "E" or a window "W" as shown in FIGS. 6-8B.

The door stopper device 10 of door stopper system 1 is illustrated with an infinity or lemniscate shape to facilitate gripping, but may have any suitable polygonal shape (and/or cross-section) such as D-shape, square, triangle, oval, etc. Door stopper device 10 includes a base 12 and a magnet 20. Base 12 of door stopper device 10 includes an outer periphery 11 that includes a first side face 12*a*, a second side face 12*b*, an upper edge 13*a*, and a lower edge 13*b*. Upper and lower edges 13*a*, 13*b* of base 12 define arcuate cutouts or concave recesses 15 disposed in opposed relation and configured for finger gripping (e.g., ergonomically fit a user's index finger and thumb), for instance, for selectively attaching or detaching door stopper device 10 to plate 100.

Figure 3:
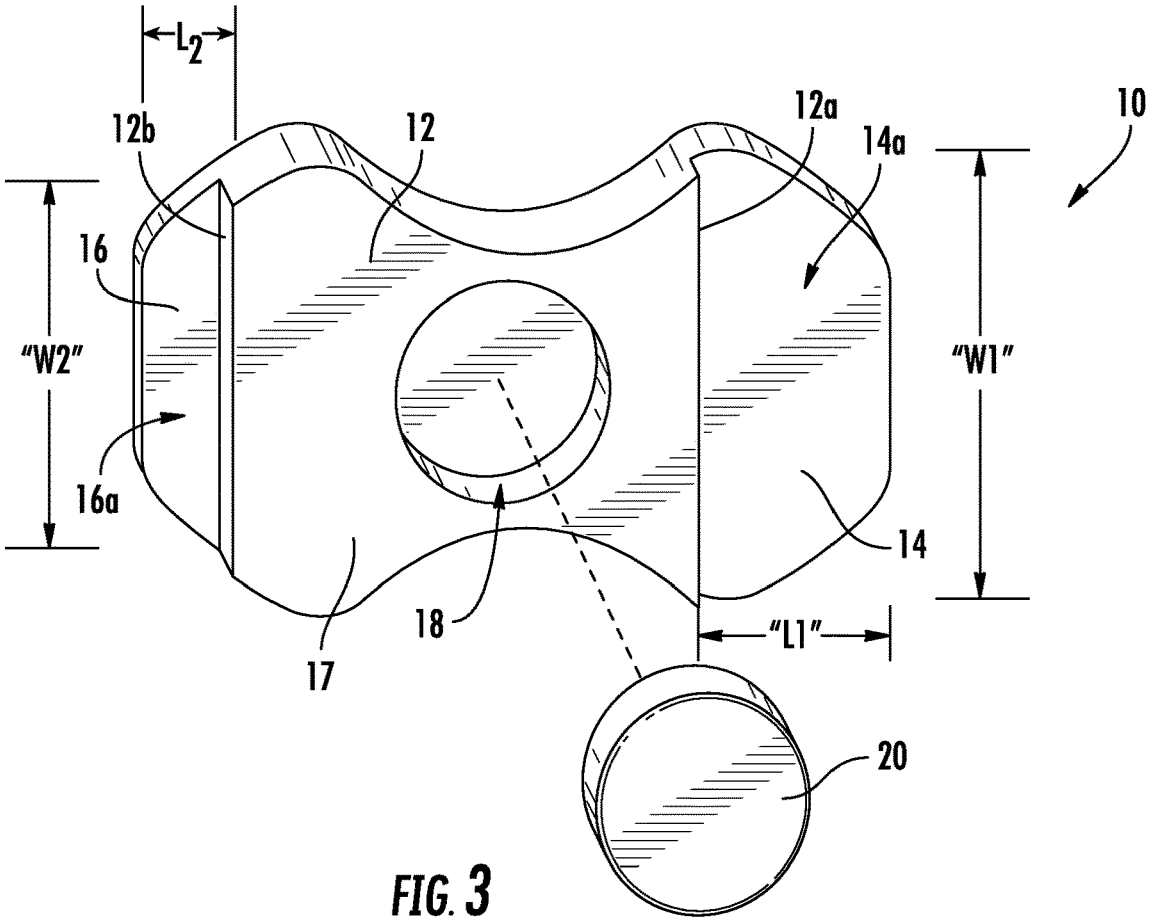
FIG. 3 is a perspective view, with parts separated, of the door stopper device of FIG. 2.

Base 12 further includes a first wing 14 that extends laterally from the first side face 12*a* and a second wing 16 that extends laterally from the second side face 12*b*. As seen in FIG. 3, first wing 14 has a first width "W1" and a first length "L1" that are greater than and a second length "L2" and a second width "W2" of second wing 16. First wing 14 and first side face 12*a* define a first receiving recess 14*a* and second wing 16 and second side face 12*b* define a second receiving recess 16*a*. As seen in FIG. 4A, first receiving recess 14*a* has a first depth "D1" and second receiving recess 16*a* has a second depth "D2" that is larger than the first depth "D1." Such dimensional differences enable door stopper device 10 to engage structures of various configurations and dimensions including various commercial and/or residential door systems. For example, first and second receiving recesses 14*a*, 16*a* of door stopper device 10 are configured to enable door stopper device 10 to be positioned between a door hinge "H" (e.g. hinge knuckle or pin) and a stop "S" of a door frame "DF" (FIG. 6) or between a floor "F" and a bottom surface of a door "D" (FIG. 9) for limiting movement of a door "D" (e.g., toward a closed position). In particular, first receiving recess 14*a* of door stopper device 10 is configured for wedged engagement with the stop "S" of the door frame "DF" while the second receiving recess 16*a* of door stopper device 10 is configured for wedged engagement with the door hinge "H" of the door "D," or vice versa, depending on the door structure (e.g., commercial or residential door structure). When the door stopper device 10 is disposed in such wedged engagement with door structure, the door stopper device 10 maintains the door "D" of such door structure in an open position.

Base 12 of door stopper device 10 further includes a mounting face 17 and a gripping face 19 that is opposite to the mounting face 17 (see FIGS. 4A and 4B). Mounting face 17 defines a central bore 18 therein for receiving magnet 20. Gripping face 19 includes any suitable surface texturing to frictionally restrain door stopper device 10 such as when door stopper device 10 is positioned on the floor "F" to block or limit movement of the door "D" (see FIG. 9). For example, such surface texturing may include ridges, knurls, bumps, grooves, etc.

Figure 8A:
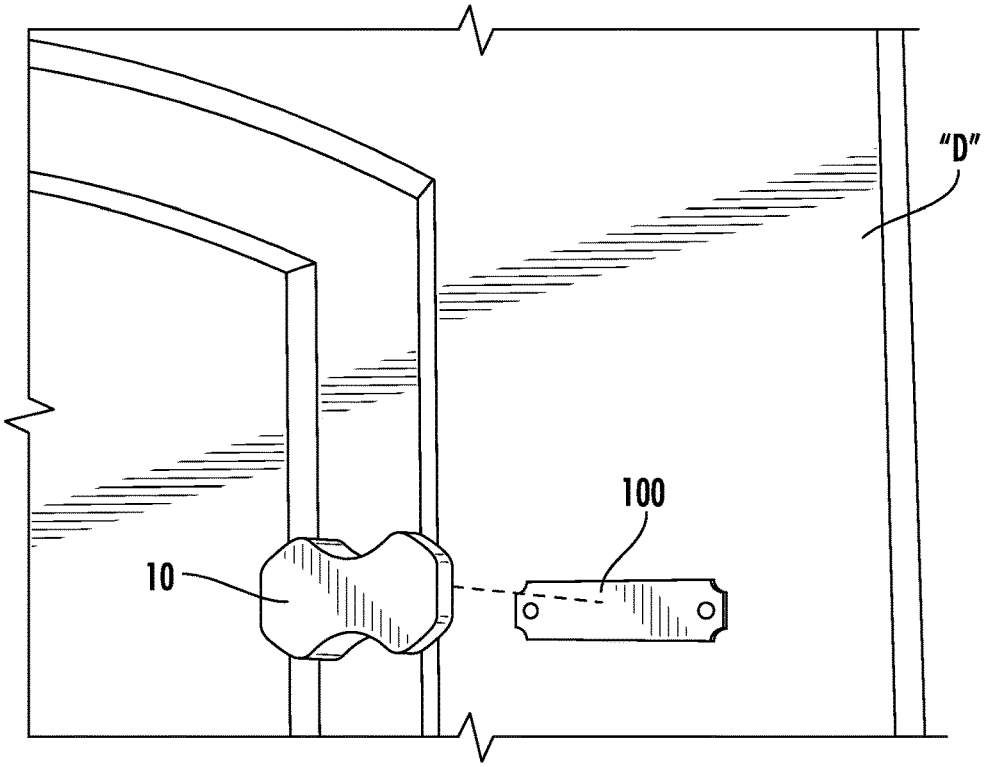
FIGS. 8A and 8B are progressive views illustrating the door stopper device of FIG. 2 being selectively attached to the plate of FIG. 5.
Figure 8B:
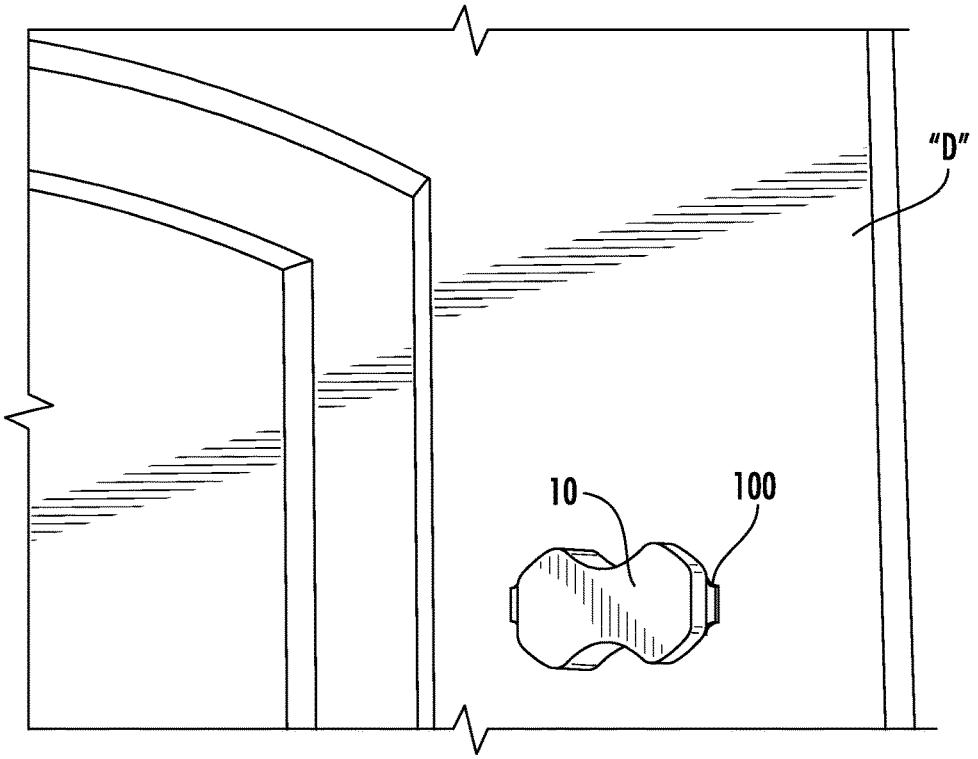

Magnet 20 of door stopper device 10 is configured to maintain door stopper device 10 selectively magnetically coupled to plate 100 of door stopper system 1 as illustrated in FIGS. 8A and 8B and/or any suitable magnetically attractive structure or material. For instance, magnet 20 may couple to a metal door, a helmet, belt, etc. Magnet 20 may be secured within bore 18 of base 12 using any suitable securement technique such as friction-fit, adhesive, etc. Magnet 20 may be made of any suitable magnetic material. In some embodiments, magnet 20 may be a ferromagnetic metal such as: iron, nickel, cobalt, gadolinium, dysprosium, steel, etc. In some embodiments, magnet 20 has a disk shape.

Figure 6:
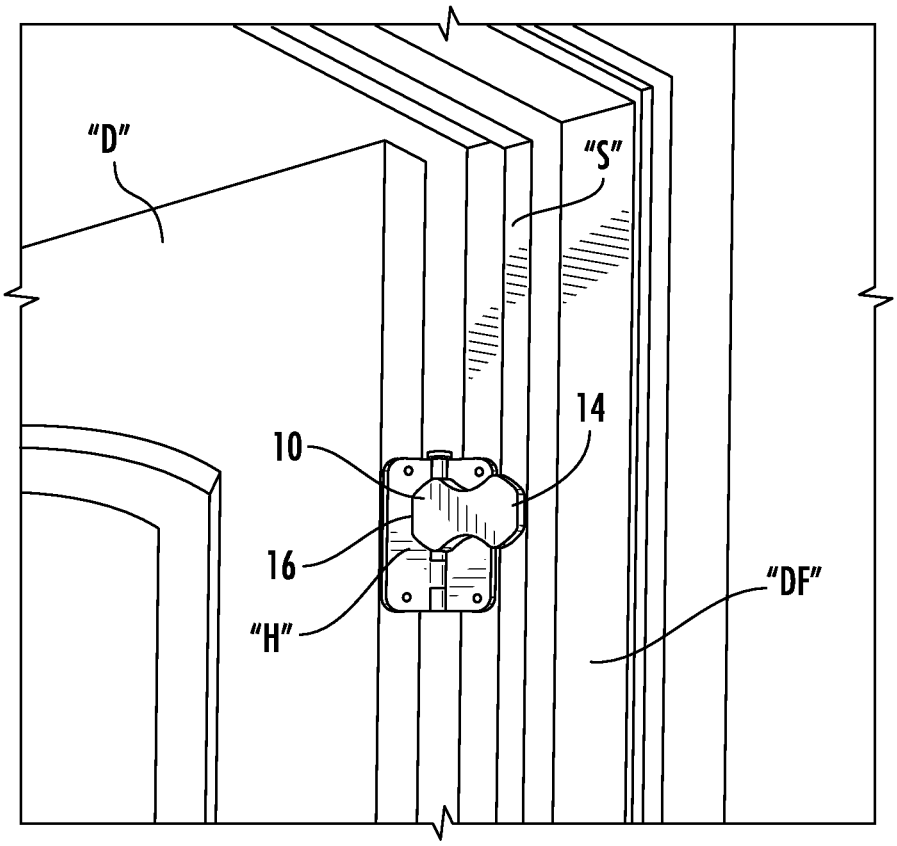
FIG. 6 is a perspective view illustrating the door stopper device of FIG. 2 positioned between a door hinge and a stop of a door frame.
Figure 7:
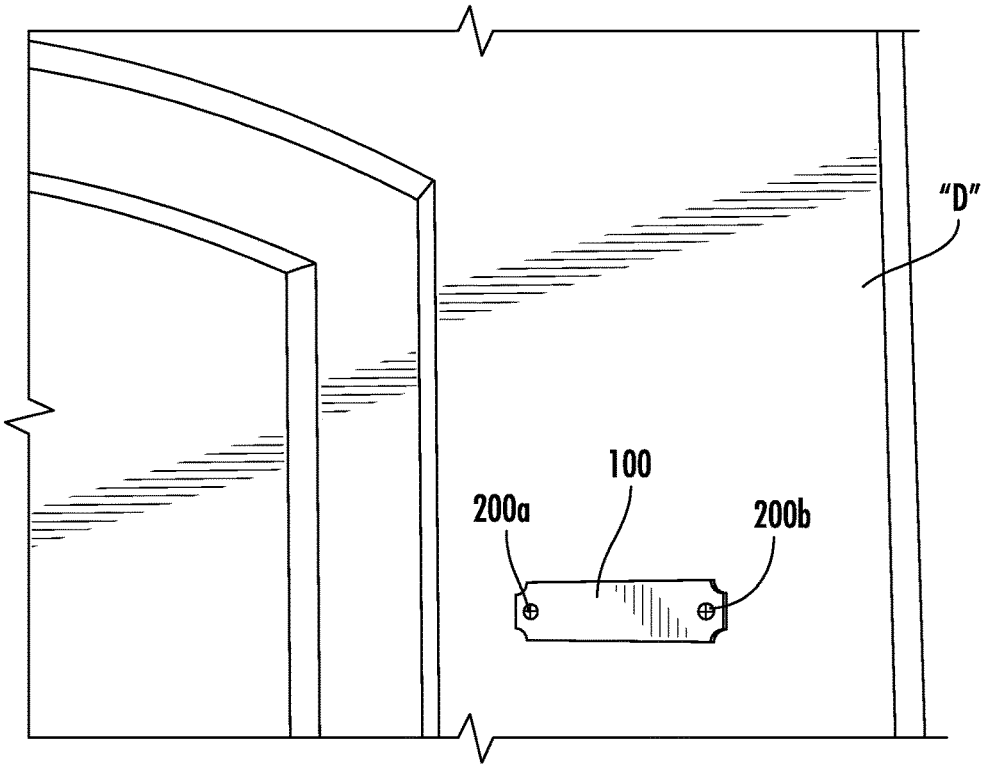
FIG. 7 is a perspective view illustrating the plate of FIG. 5 installed on a door.
Figure 9:
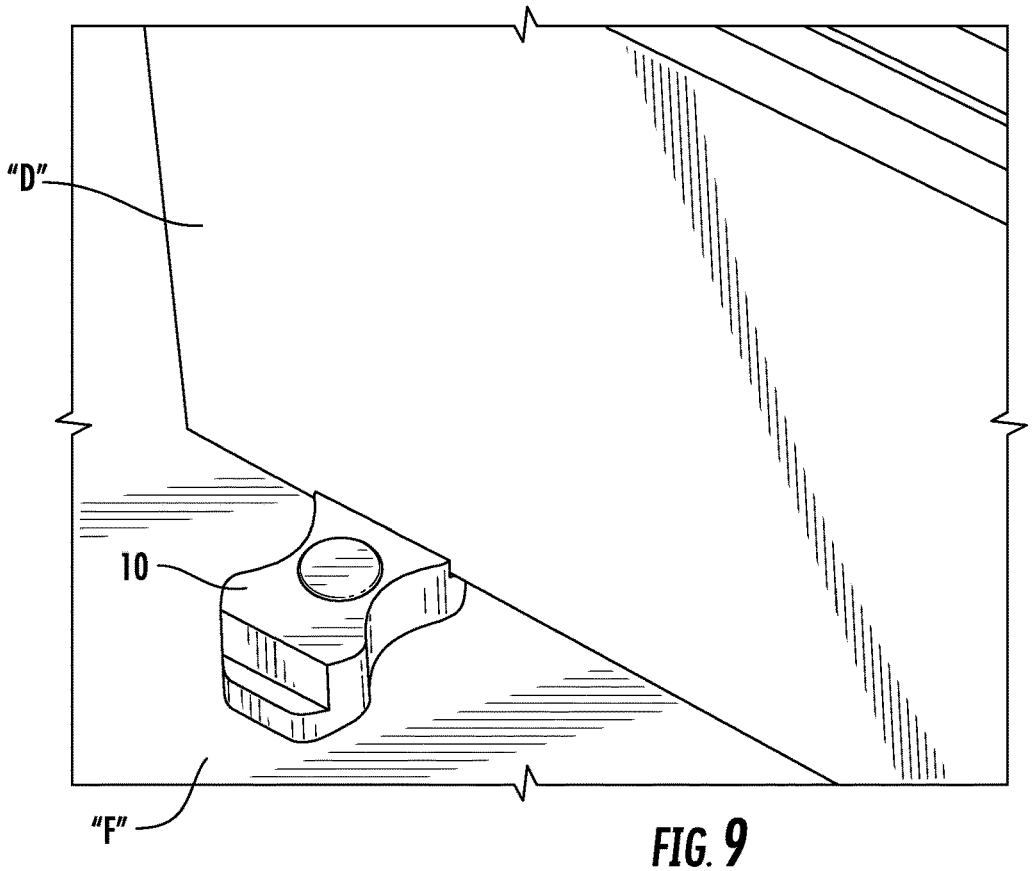
FIG. 9 is a perspective view illustrating the door stopper device of FIG. 2 positioned under a under the door.

In one example use, a user may selectively detach the door stopper device 10 from the plate 100, as illustrated in FIG. 8A, and position the door stopper device 10 into engagement with the door "D," door hinge "H" and/or door frame "DF" to maintain the door "D" in an open position such as illustrated in FIGS. 6 and 9. As desired, a user can remove the door stopper device 10 out of wedged engagement with the door "D," door hinge "H" and/or door frame "DF" so that the door "D" can be moved (e.g., closed) or repositioned to a different open position where door stopper device 10 can be reengaged with the door "D," door hinge "H" and/or door frame "DF" as desired, or reattached to plate 100 for safely storing door stopper device 10 as illustrated in FIG. 8B. This process can be repeated as desired.

In embodiments, base 102 may be made of a resilient and/or soft material such as foam, polyvinyl, ABS, or other suitable polymers. Further, base 12 may be configured to receive an elastic substrate or sleeve fabricated from a suitable textile material. The resiliency of base 12 may reduce damaging of a door or a door frame for instances when a user may attempt to close the door in abrupt manner while the doorstop is connected thereof. In embodiments, base 12 may be selectively replaceable. In embodiments, base 12 can be a reusable base 10 or may include an outer substrate which may be replaceable and/or made of a slightly flexible material fabric, or foam (e.g., sponge) designed to minimize manage thereon.

In certain embodiments, base 12 may be manufactured of a solid material like substantially hard plastic or metal in order to increase durability and to reduce wearing. For instance, base 12 may be machined out of a light and/or soft metal having magnetic properties enabling a user to attach magnetic material onto a surface of base 12, for example, ornaments (e.g., such as child's decoration project). In some embodiments, base 10 may be hollow and/or include an openable lid for storing small items like miniature toys, figures, pins, wipes, etc., therein.

Base 12 may be formed using any suitable technique such as molding, extrusion, additive manufacturing, cutting, etc.

In some embodiments, plate 100 may be in the form of a pocket, hook, ledge, or the like to support door stopper device 10.

In certain embodiments, door stopper system 1, or components thereof, may include one or more coatings such as child friendly coatings, non-toxic coatings, nonslip coatings, ruggedize coatings, etc. to enhance durability and/or storability and/or to avoid damage to a connecting to surface.

In some embodiments, although various components of door stopper device 10 are illustrated with different lengths, widths, depths, etc., such components can be provided with the same and/or different dimensions.

In some embodiments, plate assembly 100*x* is secured to door "D" using any suitable securement technique. For instance, although described herein as being attached via fasteners (e.g., screws, nails, etc.), plate assembly 100*x* may be mounted to door via adhesive, welding, clipping, crimping, etc., or combinations thereof. In some embodiments, plate 100 may have a solid shape devoid of apertures. In embodiments, the fasteners may be integrally formed with plate 100. In some embodiments, plate 100 may be integrally formed with the door "D." In embodiments, the door stopper system may be provided without a plate assembly, for instance, so that the door stopper device 10 can be utilized with a door including magnetically attractive material (e.g., metal).

Persons skilled in the art will understand that the structures and methods specifically described herein and shown in the accompanying figures are non-limiting exemplary embodiments, and that the description, disclosure, and figures should be construed merely as exemplary of particular embodiments. It is to be understood, therefore, that the present disclosure is not limited to the precise embodiments described, and that various other changes and modifications may be effected by one skilled in the art without departing from the scope or spirit of the disclosure. Additionally, the elements and features shown or described in connection with certain embodiments may be combined with the elements and features of certain other embodiments without departing from the scope of the present disclosure, and that such modifications and variations are also included within the scope of the present disclosure. Accordingly, the subject matter of the present disclosure is not limited by what has been particularly shown and described.

The invention claimed is:

1. A door stopper system comprising:

a base defining a portable body having a hinge receiving recess, the hinge receiving recess configured to receive a door hinge for wedged engagement with the door hinge to enable the base to limit pivoting closing movement of a door secured to the door hinge relative to a floor;

a plate configured to be fixed to the door or other structure proximate to the door; and a magnet secured to the base, the magnet configured to enable the base to be selectively magnetically secured to the plate for storing the base when the door stopper system is not in use as a door stop, the magnet also configured to be selectively magnetically secured to the door hinge for holding the base in position adjacent to the door hinge for enabling the base to effectuate the wedged engagement with the door hinge to limit pivoting closing movement of the door when the door stopper system is in use as a door stop.

2. The door stopper system of claim 1, wherein the base defines a cutout to facilitate user gripping of the base.

3. The door stopper system of claim 1, wherein the base includes a first wing that extends from a first side of the base to define the hinge receiving recess.

4. The door stopper system of claim 3, wherein the base includes a second wing that extends from a second side of the base to define a door frame stop receiving recess, the door frame stop receiving recess configured to receive a stop of a door frame for limiting pivoting closing movement of the door.

5. The door stopper system of claim 4, wherein the door frame stop and the hinge receiving recesses have different configurations.

6. The door stopper system of claim 1, wherein the plate includes metallic material.

7. The door stopper system of claim 1, further comprising a fastener that is configured to secure the plate to the door or other structure proximate to the door.

8. The door stopper system of claim 7, wherein the plate defines an aperture that is configured to receive the fastener.

9. A door stopper system comprising:

a base defining a portable body having a hinge receiving recess, the hinge receiving recess configured to receive a door hinge for wedged engagement with the door hinge to enable the base to limit pivoting closing movement of the door secured to the door hinge;

a plate configured to be fixed to the door or other structure proximate to the door; and a magnet secured to the base to enable the base to be selectively magnetically secured to the plate for storing the base when the door stopper system is not in use as a door stop, the magnet also configured to be selectively magnetically secured to the door hinge for holding the base in position adjacent to the door hinge for enabling the base to effectuate the wedged engagement with the door hinge to limit pivoting closing movement of the door when the door stopper system is in use as a door stop.

10. The door stopper system of claim 9, wherein the magnet has a disk shape.

11. The door stopper system of claim 9, wherein the base defines a cutout to facilitate user gripping of the base.

12. The door stopper system of claim 9, wherein the base includes a first wing that extends from a first side of the base to define the hinge receiving recess.

13. The door stopper system of 12, wherein the base includes a second wing that extends from a second side of the base to define a door frame stop receiving recess, the door frame stop receiving recess configured to receive a stop of a door frame for limiting pivoting closing movement of the door.

14. The door stopper system of claim 13, wherein the hinge and the door frame stop receiving recesses have different configurations.

15. A door stopper system comprising:

a plate configured to be fixed to the door or other structure proximate to the door;

a base defining a portable body having a first side and a second side; the base further defining:

a magnet secured to the base for selectively magnetically coupling the base to a hinge of a door for wedged engagement of the base with the door hinge to enable the base to limit pivoting closing movement of the door secured to the door hinge relative to a floor when the door stopper system is in use as a door stop, the magnet also configured to enable the base to be selectively magnetically secured to the plate for storing the base when the door stopper system is not in use as a door stop;

a first wing that extends from the first side of the base to define a hinge receiving recess for engaging the hinge; and a second wing that extends from the second side of the base to define a door frame stop receiving recess for engaging a stop of a door frame of the door when the magnet is magnetically coupled to the hinge to enable the base to limit pivoting closing movement of the door relative to the floor.

16. The door stopper system of claim 15, wherein the hinge receiving recess has a first depth and the door frame stop receiving recess has a second depth different from the first depth.

17. The door stopper system of claim 15, wherein the base defines a cutout to facilitate user gripping of the base.

18. The door stopper system of claim 15, wherein the first wing and the second wing have different widths and different lengths.

19. The door stopper system of claim 15, wherein the base is selectively positionable on the floor and underneath the door for wedged engagement with a bottom of the door, the base includes a gripping surface configured to frictionally engage the floor to prevent movement of the door when the base is disposed in wedged engagement with the bottom of the door.

* * * * *